United States Patent [19]

Ziegler

[11] Patent Number: 4,902,259

[45] **Date of Patent: * Feb. 20, 1990**

[54] CONNECTABLE POLYGONAL CONSTRUCTION MODULES

[75] Inventor: James T. Ziegler, Calgary, Canada

[73] Assignee: Novation Design Ltd., Ontario, Canada

[ * ] Notice: The portion of the term of this patent subsequent to Mar. 15, 2005 has been disclaimed.

[21] Appl. No.: 158,467

[22] Filed: Feb. 22, 1988

Related U.S. Application Data

[63] Continuation of Ser. No. 908,919, Sep. 19, 1986, Pat. No. 4,731,041, which is a continuation-in-part of Ser. No. 698,698, Feb. 5, 1985, abandoned, which is a continuation-in-part of Ser. No. 512,638, July 11, 1983, abandoned.

[30] Foreign Application Priority Data

Mar. 30, 1983 [CA] Canada ..... 424896

[51] Int. Cl.[4] ..... A63H 33/04; A63H 33/06; A63H 33/08; E04C 1/10

[52] U.S. Cl. ..... 446/117; 446/121; 446/125; 52/591; 52/594

[58] Field of Search ..... 446/102, 104, 108, 112, 446/114, 115, 116, 117, 118, 120, 121, 128, 124, 125, 126; 52/574, 589, 590, 591, 594

[56] References Cited

U.S. PATENT DOCUMENTS

| | | | |
|---|---|---|---|
| 1,860,627 | 5/1932 | Sherman | 446/113 |
| 2,610,856 | 9/1952 | Welty | 446/114 X |
| 3,442,044 | 5/1969 | Quercetti | 446/118 X |
| 3,603,025 | 9/1971 | Heubl | 446/128 X |
| 3,699,709 | 10/1972 | Schmidt | 446/114 X |
| 3,979,855 | 9/1976 | Schmidt et al. | 446/112 |
| 4,055,019 | 10/1977 | Harvey | 446/124 X |
| 4,361,979 | 12/1982 | Petersson | 446/102 |
| 4,371,166 | 2/1983 | Ferris et al. | 446/114 X |
| 4,764,144 | 8/1988 | Lyman | 446/128 |

FOREIGN PATENT DOCUMENTS

| | | | |
|---|---|---|---|
| 109181 | 5/1984 | European Pat. Off. | 446/104 |
| 908097 | 10/1962 | United Kingdom | 446/128 |
| 920030 | 3/1963 | United Kingdom | 446/116 |
| 2087743 | 6/1982 | United Kingdom | 446/102 |

*Primary Examiner*—Robert A. Hafer
*Assistant Examiner*—D. Neal Muir
*Attorney, Agent, or Firm*—Wegner & Bretschneider

[57] ABSTRACT

Polygonal construction modules are capable of being connected together by their edges and by their faces to create many different three-dimensional shapes. Each module has a generally planar body with edge faces, a top face and a bottom. Each edge face has a plurality of outwardly projecting fingers designed to provide a snap-together lateral interlock between fingers of adjacent modules while permitting hinging or rotation between modules on an axis parallel to the side face. Projecting upwardly from each top face is at least one annular connector element for establishing a friction fit with a like connector element in face-to-face interlocking engagement. The connector element includes a series of projections arranged in a uniform circular array, each projection being segmental in shape with radial side walls. The space between each pair of projections is the same shape and size as each projection whereby to snugly receive and hold a projection of a like connector element solely by frictional contact between engaging projection side walls. The body portion directly beneath each connector element is thin relative to the height and width of each projection to thereby provide the array as a whole with substantially greater flexibility than the intrinsic flexibility of each projection. In this manner, dimensional inaccuracies of the projections are accommodated when engaged with a like connector element, thereby enhancing the firmness of frictional contact between engaging projection side walls.

6 Claims, 4 Drawing Sheets

CONNECTABLE POLYGONAL CONSTRUCTION MODULES

REFERENCE TO RELATED APPLICATIONS

This application is a continuation of Ser. No. 908,919, filed Sept. 19, 1986, now U.S. Pat. No. 4,731,041, which is a continuation-in-part of Ser. No. 698,698, filed Feb. 5, 1985, now abandoned, which is a continuation-in-part of Ser. No. 512,638, filed July 11, 1983, now abandoned.

BACKGROUND OF THE INVENTION

This invention relates to building polyhedra building toys and, more particularly, to polygonal construction modules capable of being connected together by their edges and by their faces.

Various types of construction toys and sets have been known and one example is shown in Zimmerman, U.S. Pat. No. 2,776,521 issued Jan. 8, 1957. The object of the Zimmerman design is to provide a construction toy in which the basic units are flat, simple geometric figures, such as squares or equilateral triangles which are adapted to be joined to each other to form three-dimensional figures. In particular, it relates to a construction toy in which the basic units are provided with identical edges adapted to mesh to form a hinge and allow a large number of configurations to be assembled, including many regular three-dimensional geometric shapes.

Another form of construction set with modular elements is described in Quercetti, U.S. Pat. No. 3,442,044 issued May 6, 1969. This design utilizes a combination of facially projecting pins and corresponding recesses which allows connecting together of the modular components.

Another prior design in which modular components are connected together by means of a series of pin-like prongs is described in Heubl, U.S. Pat. No. 3,603,025 issued Sept. 7, 1971.

It is an object of the present invention to provide polygonal construction modules capable of being fastened to one another both edge-to-edge, face-to-face and face-to-back.

SUMMARY OF THE INVENTION

One principal feature of the present invention relates to a polygonal construction module comprising a body portion having edge faces, a top face and a bottom face with each of the edge faces having a plurality of outwardly projecting fingers of square or rectangular cross-section. The fingers are designed to provide a snap-together lateral interlock between fingers of adjacent modules while permitting hinging or rotation between modules on an axis parallel to the side face. Mating shaped portions on the body top and bottom faces provide face-to-face joining between modules.

According to an important feature of the invention, the top face of each module has projecting upwardly therefrom at least one annular connector element for establishing a friction fit with a like connector element in face-to-face interlocking engagement. The connector element includes a series of projections arranged in a uniform circular array, each projection being segmental in shape with radial side walls. The space between each pair of projections is the same shape and size as each projection whereby to snugly receive and hold a projection of a like connector element solely by frictional contact between engaging projection side walls. The body portion directly beneath each connector element is thin relative to the height and width of each projection to thereby provide the array as a whole with substantially greater flexibility than the intrinsic flexibility of each projection. In this manner, dimensional inaccuracies of the projections are accommodated when engaged with a like connector element, thereby enhancing the firmness of frictional contact between engaging projection side walls.

In order to mold attractive modules having smooth, glossy surfaces, a plastic is used which is relatively stiff and has a relatively hard surface. A typical plastic for this purpose is ABS. Each connector element preferably has an outer diameter of about 10–20 mm and it is also desirable to use a small number, e.g. fewer than 10, segmental projections in each connector. Also for a firm friction interlock between connector elements, each segmental projection preferably has a height at least equal to the height of the body portion edge face, with a height of 3.5 mm to 5.0 mm being particularly preferred. Such projections have substantial stiffness, but it has been found that the array of segmental projections as a whole can be provided with substantial flexibility by mounting them on a relatively thin support base. This flexibility can accommodate dimensional inaccuracies of the projections when engaged with a like connector element and enhance the firmness of frictional contact between engaging radial side walls. The ratio of support base thickness to projection height is preferably less than 1:4.

This design has the special advantage that because of the resiliency of the supporting base for the projections, the modules can easily be joined or separated by a child, while not accidentally separating.

The edge joining system is a snap and secure hinging joint, i.e. by means of mating convex projections and concave depressions, which permits infinite dihedral angles. The edge length of each polygon is usually an equal multiple of the base unit edge length. This system is capable of producing innumerable regular and irregular polygons, polyhedra, and clusters of polyhedra in space filling arrays and open packing arrays. The shapes and forms created with the components of the system are intrinsically spatial and geometric, paralleling high-tech structures, futuristic space-age forms and elemental crystalline forms. Thus, it provides a creative and educational building toy.

The modules of the present invention provide an omnidirectional, polyhedral toy building system. The modular units are principally planar, simple polygon shapes which fasten together edge-to-edge and/or face-to-face. Usually, each module has an over all thickness to edge length ratio of less than 1:8, although ratios greater than 1:8 may be used for some purposes.

The edges of each polygonal module have a linear series of projecting fingers symmetrically congruent to each side of the regular polygon module and to each equal length side in the case of irregular polygon modules. At least one projecting finger has a convex projection on one side and at least one finger has a corresponding concave depression on an opposite side. Alignment of the projecting fingers is such that the fingers and the space between the fingers on the side of one polygon inversely match any side of another polygon. Pressing the fingers of two polygons together joins them into a snap-secure interlocking hinge joint which can be dismantled by pulling the pieces apart.

The same sequence of interlocking projecting fingers or equal multiples thereof are symmetrically arranged along each modular polygon providing edge-to-edge matching of the modular units with one another. It has been found preferable to use three or four fingers along each edge face.

The number of segmental projections in each connector element and the number of fingers along each edge face can vary widely. However, for ease of construction and ease of use of the modules, six projections per connector element are preferably used.

The annular connector elements are a particularly important feature of the invention, in that they permit not only face-to-face connections, but also make possible the connection of many auxiliary components. Thus, they may be used as a means for attaching columns, axle supports, pivotal arms, ball and socket joints, etc.

DESCRIPTION OF THE DRAWINGS

The invention is further illustrated with reference to the attached drawings which, by way of non-restrictive examples, illustrates a variety of construction elements and some structures according to the invention. In the drawings.

Figure 1:
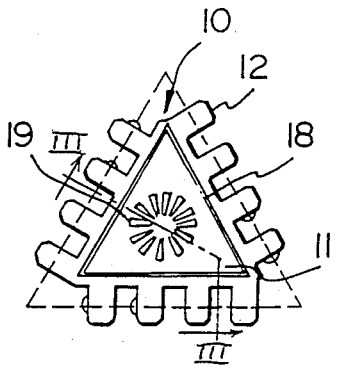
FIG. 1 is a top plan view of a basic module of the invention.
Figure 2:
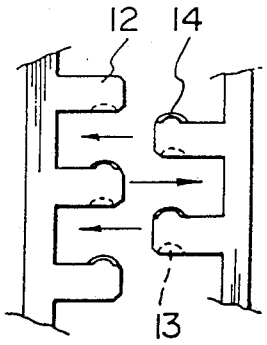
FIG. 2 is a side elevation showing details of an edge-to-edge connection.
Figure 3:
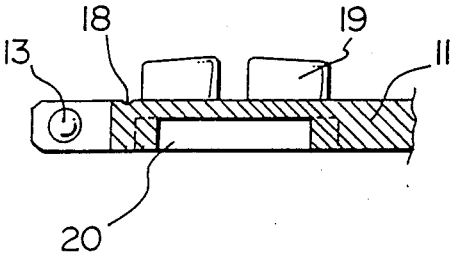
FIG. 3 is a partial sectional view of the module of FIG. 1, along line III—III of FIG. 1.
Figure 4:
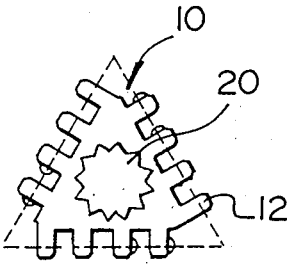
FIG. 4 is a bottom plan view of the module of FIG. 1.

Referring now in more detail to the drawings, and particularly to FIGS. 1–4, there is shown a basic polygonal construction module 10 of triangular configuration and having a generally planar body portion 11. Projecting from the three lateral edges of this planar triangular body are a series of outwardly projecting fingers 12 of square or rectangular cross-section. The edge faces of these fingers 12 have mating concave depressions 13 and convex projection 14 arranged as shown in FIG 2.

These modules connect edge-to-edge in a hinged fashion by means of the projections 14 and the depressions 13 and can also be connected together in a face-to-face configuration by means of connector elements 19.

The connector element 19 consists of upwardly extending segmental projections which are radially, equally spaced in a circular configuration. As can be seen from FIG. 3 and 4, the bottom face of this module has a star-shaped recess 20 and the top of this recess forms the thin base for the projections. The top face of the module also has an indentation or scoreline 18 formed inset a short distance from the three edges of the module.

A particularly preferred embodiment of the invention is shown in FIGS. 5 to 8. This module 60 has a planar top face 61 surrounded by a downwardly projecting edge flange or rim 64 defining the edge face of the module. This edge face includes laterally projecting fingers 62 with gaps 63 therebetween, with the rim 64 forming the edges of the fingers 62 and gaps 63. In association with each edge group of fingers, there is at least one concave depression 68 and at least one convex projection 69 to provide the lateral interlock between fingers.

Projecting upwardly from the top face is an annular connector element 66 consisting of a series of segment shaped projections. Also projecting downwardly from the bottom of the module is a circular flange 65 which forms a bottom socket or recess 67. This socket 67 has a diameter corresponding to the diameter of a connector 66 such that the connector will snugly fit within the socket 67. Also, corresponding projections from different modules will connect with each other.

The embodiment of FIGS. 5 to 8 is particularly advantageous in that the entire module is made from relatively thin plastic material. This is particularly advantageous at the molding stage and assists in the production of a module of very precise dimensions.

Figure 13:
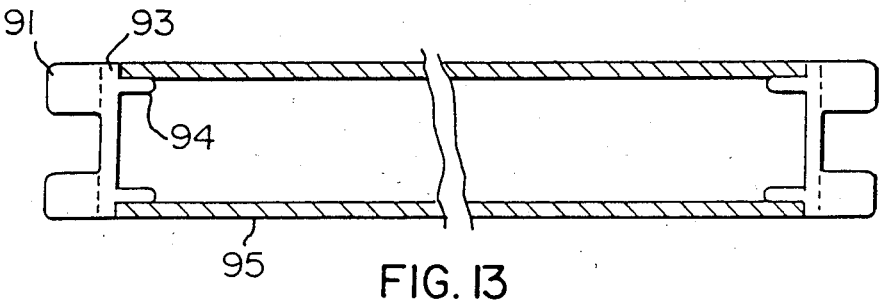
FIG. 13 is a sectional view of a long connector column.
Figure 17:
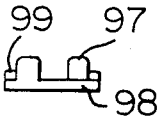
FIG. 17 is a side elevation of the hub cap of FIG. 16.

A square module compatible with the triangular module 60 of FIG. 13 is shown in FIG. 17. This module 70 has a planar body portion 71 with each of the four edges having projecting finger portions. These include a corner projection 72, a central projection 73 and a third projection 74. Each corner projection 72 has a convex projection 75 on the inner edge thereof and each projection 74 has a concave depression 76 on the outer edge thereof. The planar body portion 71 has a hole 77 extending therethrough. This hole 77 has a diameter which snugly receives the connector element 66.

Figure 5:
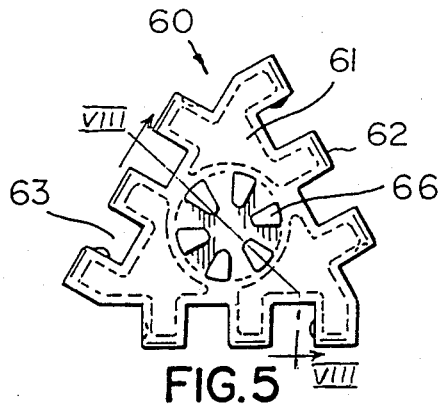
FIG. 5 is a top plan view of an alternative module of the invention.
Figure 6:
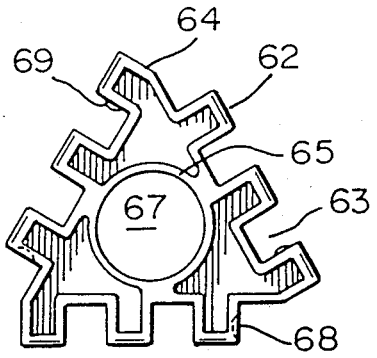
FIG. 6 is a bottom plan view of the module of FIG. 5.
Figure 7:
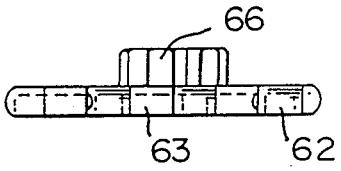
FIG. 7 is a side elevation of the module of FIG. 5.
Figure 8:
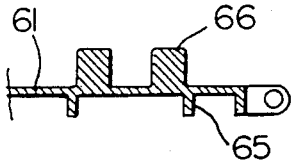
FIG. 8 is a partial sectional view of the module of FIG. 5, along line VIII—VIII of FIG. 5.
Figure 9:
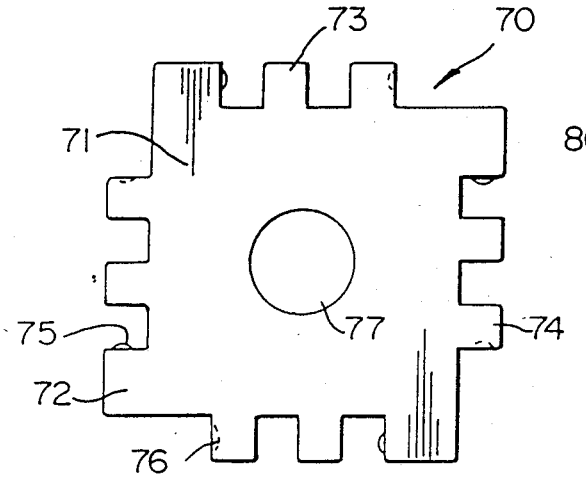
FIG. 9 is a top plan view of a further square module.
Figure 10:
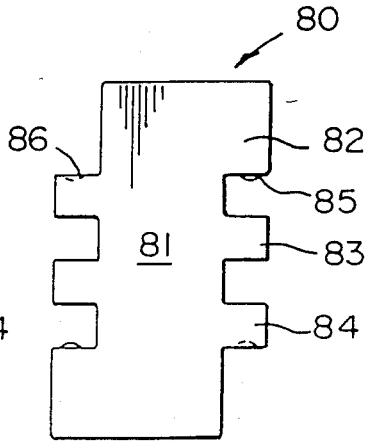
FIG. 10 is a top plan view of a further rectangular module.

A rectangular module compatible with the triangular module of FIG. 5 is shown in FIG. 10. This module 80 has a planar body portion 81 with projecting fingers on the two opposite long sides only. These projecting fingers include a corner portion 82, a central portion 83 and a third portion 84. The inner face of each corner portion 82 has a convex projection 85 and the outer face of each third portion 84 has a concave depression 86.

Figure 11:
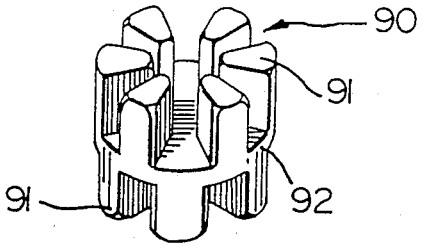
FIG. 11 is an isometric view of a short connector column.

One of the auxiliary components which can be connected by way of the connector 66 is shown in FIG. 11. This is a short column 90 composed of back-to-back connector elements 91 mounted to a central web portion 92.

Figure 12:
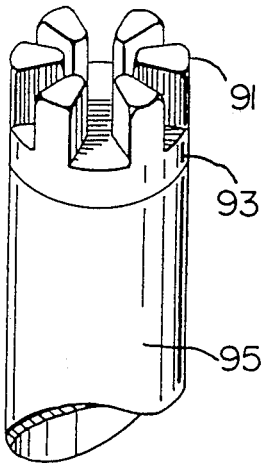
FIG. 12 is an isometric view of part of a long connector column.

It is also possible to form a long column member as shown in FIGS. 12 and 13. The column member comprises a tube 95 and end portions 93 having segmental projections 91 extending from one face thereof and an annular rim 94 projecting from the other face thereof.

The annular rim 94 fits snugly within the tube 95, this tube 95 being of any desired length.

Figure 14:
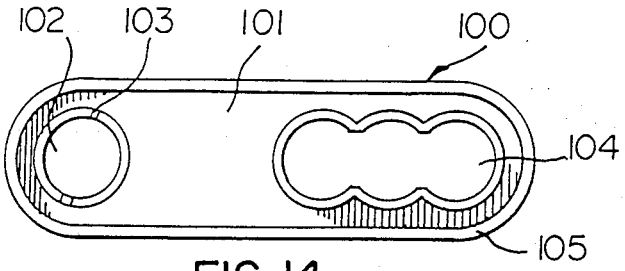
FIG. 14 is a top plan view of a pivotal connector arm; 14.

The versatility of the connector element of the invention is further illustrated in FIGS. 14 to 20. An arm member 100 is shown in FIG. 14 and this includes the planar body portion 101 surrounded by an edge rim 105. At one end of the body portion is circular hole 102 surrounded by a rim and at the other end is an elongated hole 104, again surrounded by a rim. The surrounding rim of hole 102 includes slots 103.

Figure 16:
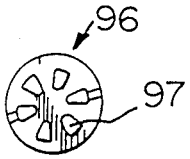
FIG. 16 is a bottom plan view of a hub cap.
Figure 15:
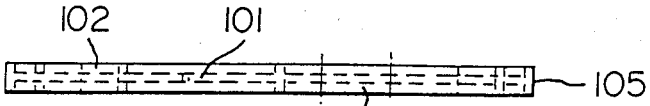
FIG. 15 is a side elevation of the arm of FIG.

FIGS. 16 and 17 illustrate a hub cap 96 consisting of a planar body portion 98 with segmental projections 97 extending from one face thereof. Additional projections 99 may be provided which lock in the slots 103 of arm 100. The projection of hub cap 96 are adapted to mate with the projections of the construction modules, such as the triangular module 60. Thus, the hub cap 96 and the triangular module may be joined in the manner shown in FIG. 19. It is also possible to join two triangular members 60 in the same manner as illustrated in FIG. 18.

Figure 18:
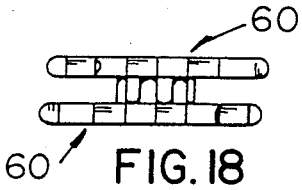
FIG. 18 is a side elevation of two triangular modules jointed together.
Figure 19:
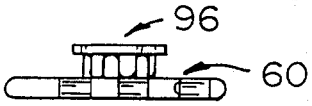
FIG. 19 is a side elevation of a hub cap and triangular module according to FIG. 5 joined together.

It will be seen from FIGS. 18 and 19 that when components are joined by interconnection of segmental projections, a complete circular hub is formed which may then become a pivot point for mounting wheels, pivotal arms, etc.

Figure 20:
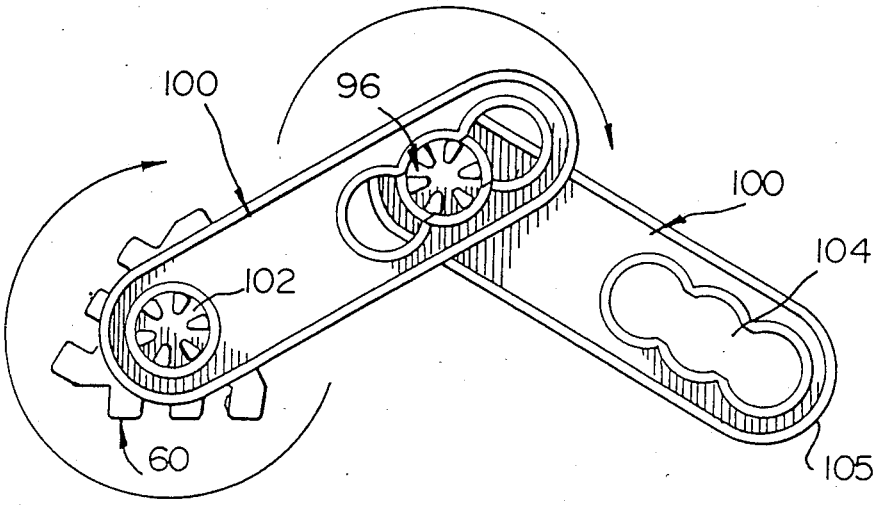
FIG. 20 is a top plan view of two pivotal connector arms jointed together.

This is better seen in FIG. 20 where two arms 100 are being connected. Here the circular hole 102 of the lower arm 100 has been placed in register with the elongated hole of the upper arm 100. A hub cap 96 has been placed in position from the bottom and the full connection of the two arms 100 can be completed by joining to the hub cap 96 either a further hub cap 96 or a triangular module 60.

The circular hole of the upper arm 100 contains the annular connector element of a triangular module 60 and this module 60 can be rotatably held within hole 102 by means of either a second triangular module 60 or a hub cap 96 interconnected by way of annular connector elements.

While various changes may be made in the detail construction, it shall be understood that such changes shall be within the spirit and scope of the present invention as defined by the appended claims.

I claim:

1. A toy construction module comprising a body portion having edge faces, a top face and a bottom face, each said edge face having a plurality of outwardly projecting fingers with gaps therebetween, said fingers being arranged to provide a snap-together lateral interlock between fingers of adjacent modules while providing hinging action between said adjacent modules on an axis parallel to a said edge face, and a connector hub projecting upwardly from the module top face for establishing a friction fit with a like connector hub of another toy construction module in face-to-face interlocking engagement, said connector hub comprising a series of fin projections of substantially the same uniform height arranged in a uniform circular configuration, each fin being sectoral in cross-section with radial side walls, and the fin projections being radially spaced so as to engage substantially identical fin projections of said like connector hub therebetween in interlocking engagement solely by frictional contact between engaging fin side calls sufficient to retain the module and said another module adjacent one another.

2. A module according to claim 1 wherein each connector hub contains six fin projections.

3. A module according to claim 2 wherein each fin projection extends about 3.5 to 5.0 mm above the top face.

4. A toy construction element comprising a body portion having a connector hub projecting upwardly from at least one face thereof for establishing a friction fit with a like connector hub of another toy construction element in face-to-face interlocking engagement, said connector hub comprising a series of fin projections of substantially the same uniform height arranged in a uniform circular configuration, each fin being sectoral in cross-section with radial side walls and the fin projections being radially spaced so as to engage substantially identical fin projections of said like connector hub therebetween in interlocking engagement solely by frictional contact between engaging fin side walls sufficient to retain the element and said another element adjacent one another.

5. A toy component according to claim 4 wherein each connector hub contains six fins.

6. A toy component according to claim 4 wherein the fins project about 3.5 to 5 mm from said face.

* * * * *